United States Patent [19]

Davis et al.

[11] Patent Number: 4,517,898

[45] Date of Patent: May 21, 1985

[54] HIGHLY ACCURATE PROJECTILE FOR USE WITH SMALL ARMS

[76] Inventors: Dale M. Davis, Rte. 2, Box #130; John C. Robbins, Rte. 2, Box #62, both of Freeport, Fla. 32439

[21] Appl. No.: 419,253

[22] Filed: Sep. 17, 1982

Related U.S. Application Data

[63] Continuation-in-part of Ser. No. 103,644, Dec. 14, 1979, abandoned.

[51] Int. Cl.[3] ..... F42B 11/08

[52] U.S. Cl. ..... 102/514; 102/517

[58] Field of Search ..... 102/501, 514–517

[56] References Cited

U.S. PATENT DOCUMENTS

| | | | |
|---|---|---|---|
| 549,334 | 11/1895 | Smith . | |
| 680,549 | 8/1901 | Smith | 102/507 |
| 1,043,547 | 11/1912 | Stanbridge | 102/501 |
| 2,172,054 | 9/1939 | Di Brazza Savorgnan | 102/501 |
| 2,414,863 | 1/1947 | Foster | 102/517 |
| 3,232,233 | 2/1966 | Singleton | 102/501 |
| 3,918,364 | 11/1975 | Duer | 102/501 |
| 4,015,535 | 4/1977 | Bond, Jr. | 102/516 |

FOREIGN PATENT DOCUMENTS

| | | | |
|---|---|---|---|
| 56754 | 5/1891 | Fed. Rep. of Germany | 102/514 |
| 1407444 | 6/1965 | France | 102/501 |
| 18004 | 2/1903 | Sweden | 102/514 |

*Primary Examiner*—Harold J. Tudor

*Attorney, Agent, or Firm*—Donald J. Singer; Jacob N. Erlich

[57] ABSTRACT

A highly accurate projectile for use with small arms especially pistols and revolvers, having a cylindrically-shaped body portion and a nose formed adjacent thereto. The cylindrically-shaped body has a length which is equal to at least half the overall length of the projectile in order to position the center of gravity of the projectile within the body portion. The nose of the projectile is in the nominal shape of a truncated cone having sides which are rounded at the forward end thereof in order to meet a flat front surface. The flat front surface locates the center of pressure of the projectile well forward of the center of gravity of the projectile. The unique configuration and distribution of weight of the projectile allows for its highly accurate use with small arms.

5 Claims, 7 Drawing Figures

FIG. 1
PRIOR ART
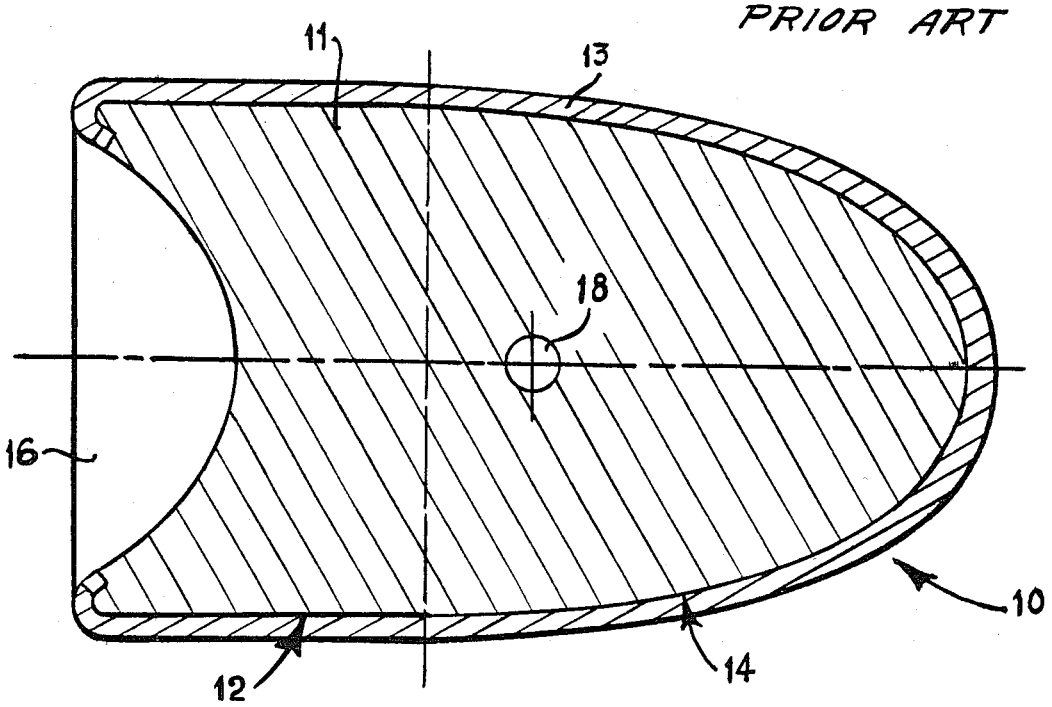
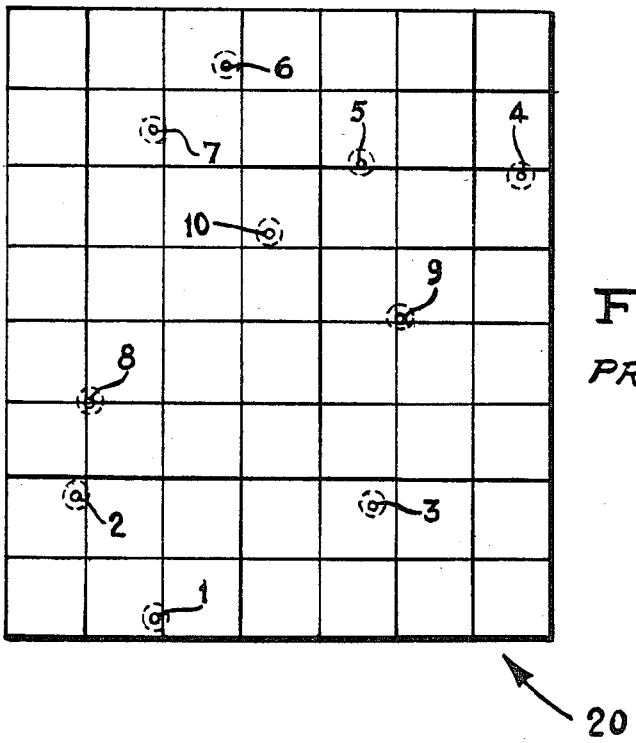
FIG. 2
PRIOR ART

HIGHLY ACCURATE PROJECTILE FOR USE WITH SMALL ARMS

STATEMENT OF GOVERNMENT INTEREST

The invention described herein may be manufactured and used by or for the Government for governmental purposes without the payment of any royalty thereon.

CROSS REFERENCE TO COPENDING U.S. PATENT APPLICATION

This patent application is a continuation-in-part of copending U.S. patent application Ser. No. 103,644 filed Dec. 14, 1979 now abandoned by the same inventors.

BACKGROUND OF THE INVENTION

This invention relates generally to ammunition, and, more particularly to a highly accurate military type jacketed projectile for use with pistols, revolvers, submachine guns, or other weapons utilizing ammunition of the general proportions of pistol ammunition.

Small arms form a major portion of the ever expanding weapon industry. The term small arms embraces not only hand and shoulder weapons but also machine guns and automatic weapons of all sizes up to about 20 mm in caliber. One specific class of small arms, pistols, revolvers, and submachine guns (machine pistols) is characterized by a type of ammunition generally referred to as pistol ammunition, and in military configuration with full metal jackets, is generally accepted as being inaccurate. Some types of wadcutter, semi-wadcutter and hollow point ammunition developed for target and sporting uses, are reasonably accurate, but they do not satisfy international laws of warefare which requires that the bullet remain intact and not significantly deform upon impact with the human body. This requirement is usually satisfied by encasing the projectile in a jacket of cupronickel, gilding metal, or gilding metal clad steel. It is these "full metal jacketed" or "full patch" projectiles or bullets to which this invention applies.

More specifically, ammunition for small arms is conventionally referred to as a round and is made up of a cartridge case which contains therein, although not limited to, a percussion primer, a charge of smokeless powder, and a projectile (more commonly referred to as a bullet). The cartridge case is generally utilized to assemble the primer, powder charge, and projectile in one weather proof unit, in order to support these elements in their relative positions in the chamber, and to provide obturation during firing by expanding against the wall of the chamber, thus preventing escape of the powder gases to the rear. The physical properties of the case must be such as to provide the necessary strength to withstand firing and extraction stresses. The front end of the case forms the seat for the projectile or bullet.

The reasons for the inaccuracy of small arms ammunition are not well understood. For example, the typical configuration of the projectile or bullet has an ogive (nose) of a long elipitcal shape blending smoothly into a short cylindrical body. The base of the body is hollowed out to bring the weight of the projectile down to the desired value while retaining the streamlined profile. The resultant center of gravity of the projectile is therefore well forward, commonly within the ogive. An example of such a projectile can be found in U.S. Pat. No. 2,172,054.

As far as the accuracy is concerned with respect to such projectile configurations, it is clearly unacceptable. For example, a typical ten-shot group at fifty yards range for the U.S. 9 millimeter M-1 ball round has an extreme spread of approximately 8 inches. Consequently, much need arises in the area of small arms ammunition to produce a projectile (or bullet) which is capable of providing highly accurate performance.

SUMMARY OF THE INVENTION

The jacketed projectile of this invention overcomes the problems set forth in detail hereinabove by providing a projectile, which, by its unique configuration and distribution of weight allows for highly accurate usage with small arms.

The projectile of this invention relies, for its construction, in the utilization of three factors, that is, (1) the in-bore yaw, the angle between the geometric axis of the projectile and the bore axis; (2) the first maximum yaw, the maximum misalignment between the projectile axis and the nominal trajectory; and (3) the damping characteristics, the aerodynamic and mass properties which reduce this yaw in flight. By the proper analysis of these factors it has been determined that in order to make a highly accurate projectile for small arms, the cylindrical body portion of the projectile must be as long as practical while the entire projectile length must be as short and stubby as practical. This configuration is designed with an additional factor of importance being that the center of pressure (drag) of the projectile must be as far forward of the center of gravity as possible. This is accomplished by a nose being in the shape of a truncated cone, that is having a flat front. A truncated cone is used for simplicity, however, any reasonably smooth transition between the flat nose and cylindrical body will suffice. A high drag coefficient is beneficial, especially if it acts well forward.

In addition, the center of gravity of the projectile of this invention must be located within the cylindrical body portion of the projectile, that is, as far to the rear within the cylindrical body portion as practical. In order to do so it is therefore desirable to eliminate the hollow rear portion of the body. Futhermore, it may also be beneficial to construct the cylindrical body portion of the projectile of a heavier (denser) material than the nose of the projectile, thereby even further moving the center of gravity of the projectile to the rear. With such a configuration projectiles made within the scope of this invention typically provide a ten-shot extreme spread at fifty yards range of only one inch. The improvement recognized with the instant invention is approximately a betterment of accuracy of approximately eight times compared with the pistol ammunition utilized in the past.

It is therefore an object of this invention to provide a projectile for use with small arms which is capable of being extremely accurate.

It is another object of this invention to provide a full metal jacketed military type projectile which is legal under international law yet is extremely accurate.

It is another object of this invention to provide a projectile for use with small arms that is capable of increasing its accuracy by shifting the center of pressure forward by the flattening of the nose.

It is still another object of this invention to provide a projectile for use with small arms that increases its accuracy by shifting the center of gravity to the aft portion of the cylindrical body.

It is a further object of this invention to provide a projectile for use with small arms in which the accuracy is increased by maximizing the cylindrical body portion of the projectile with respect to the overall length of the projectile.

It is still a further object of this invention to provide a projectile for use with small arms which increases the accuracy thereof by assuring that the center of gravity is well within the cylindrical body of the projectile.

It is still a further object of this invention to provide a highly accurate projectile for small arms which is economical to produce and lends itself to standard mass producing manufacturing techiniques.

For a better understanding of the present invention together with other and further objects thereof, reference is made to the following description taken in conjunction with the accompanying drawing and its scope will be pointed out in the appended claims.

DETAILED DESCRIPTION OF THE DRAWING

FIG. 1 is a side elevational view of a conventional projectile closely resembling the U.S. 9 mm M1 ball round utilized for small arms and shown in cross section;

FIG. 2 is an illustration of a typical target for use with small arms ammunition showing the extreme spread of a ten-shot group at fifty yards utilizing the conventional projectile of the type shown in FIG. 1;

DETAILED DESCRIPTION OF THE PREFERRED EMBODIMENT

Figure 3:
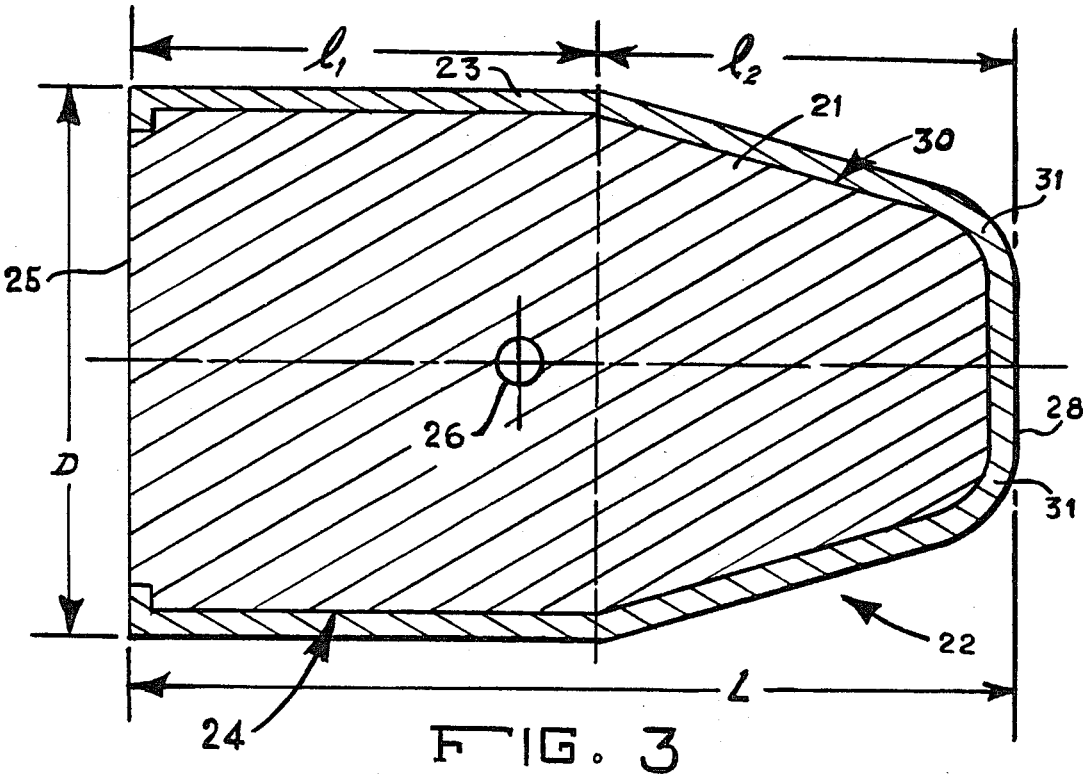
FIG. 3 is a side elevational view of the highly accurate projectile of this invention for use with small arms and shown in cross section.

Reference is now made to FIG. 1 of the drawing where a projectile or bullet 10 of conventional configuration and as well known in the prior art is clearly illustrated. Projectile 10 is made up of a short cylindrical body portion 12 and a long elliptically shaped ogive or nose 14. In addition, the rear area 16 of cylindrical body portion 12 is of a concave configuration in order to reduce the weight of projectile 10 while retaining the streamlined profile thereof. The core 11 of the projectile is usually made of lead or lead alloy but may also be made of iron or steel or a combination of the above. The entire projectile, except for part of the base is encased in a jacket 13 of gilding metal, cupronickel or gilding metal clad steel, for the purpose of maintaining form and integrity after impact with the human body.

As a result of the type of configuration utilized in the prior art, the center of gravity 18 of projectile 10 is located within the ogive or nose 14. This type of structure results in highly inaccurate firing as indicated by target 20 shown in FIG. 2 of the drawing. In FIG. 2 ten shots (numbered 1 through 10) are illustrated. Shots 1 through 10 have been fired at a distance approximately 50 yards from target 20 utilizing the type of projectile 10 or bullet as shown in FIG. 1 in the drawing (typically a 9 mm M-1 ball round).

To alleviate the inaccuracy of projectile 10, that is, the type of ammunition utilized in the past with military pistols, this invention provides a projectile 22 as depicted in FIG. 3 of the drawing. Projectile 22 relies on its unique configuration and weight dispersement for its accurate performance with small arms.

Although the exact reasons for ammunition accuracy are not well understood, if we are to assume a perfect gun barrel and an accurately made projectile which is not adversely deformed, three factors become dominant: (1) the in-bore yaw, the angle between the longitudinal geometric axes of the projectile and bore axis; (2) the first maximum yaw, the maximum of misalignment between the projectile axis and the nominal trajectory; and (3) the damping characteristic, the aerodynamic and mass properties which reduce this yaw in flight.

The first maximum yaw is a dominant factor in generating lift in random direction, causing dispersion. For maximum accuracy it must be minimized. Its controlling equation is set forth hereinbelow.

$$\alpha_m \approx \left(2\frac{I_y}{I_x} - 1\right) \frac{\alpha_b}{\sqrt{1 - \frac{1}{S_g}}}$$

Where:

$\alpha m$ = first maximum yaw $I_x$, $I_y$ = axial and transverse moments of inertia $\alpha_b$ = In-bore yaw $S_g$ = gyroscopic stability The controlling equation for dispersion per se is set forth hereinbelow:

$$Dis \approx \left(\frac{C_{n\alpha} - C_d}{C_{m\alpha}}\right)\left(\frac{I_y - I_x}{MD^2}\right)\left(\frac{\omega D}{V}\right)(\alpha_b)$$

Where:

$C_{n\alpha}$ = Normal force coefficient $C_d$ = Drag coefficient $C_{m\alpha}$ = Overturning moment coefficient M = Mass D = Diameter $\omega$ = Spin rate V = Velocity An analysis of the above equations indicate that in order to make the accurate projectile 22 of this invention which is capable of being utilized with small arms the following conditions must be obtained:

a. The cylindrical body portion 24 of projectile 22 must be as long as practical to provide a long bearing length in order to minimize in-bore yaw since $\alpha_b$ appears as a linear factor in both equations.

b. Projectile 22 must be as short and stubby as practical in order to maximize $I_x$ in relation to $I_y$.

c. The configuration of the projectile 22 must be such that the center of pressure (drag) is as far forward of the center of gravity 26 as possible. This maximizes $C_m$ which is a linear factor in the denominator of the dispersion equation. Such a condition can be achieved by providing a flat surface 28 on the nose portion 30 of projectile 22 of this invention. Making nose portion 30 of a truncated cone shape produces flat nose 30.

d. The provision of a high drag coefficient $C_d$, especially if it acts well forward.

e. The center of gravity 26 must be within the cylindrical body portion 24 of projectile 22 in order to substantially reduce bore yaw. To minimize in bore yaw the CG should be at the exact center of the cylindrical section. To dampen first maximum yaw it should be as far aft as practical.

As clearly illustrated in FIG. 3 of the drawing, projèctile 22 meets all the criteria set forth hereinabove. The length, $l_1$, of cylindrical body portion 24 is large with respect to the length, $l_2$, of nose portion 30. In fact, ideally the relationship between the length, $l_1$, of body portion 24 and length, $l_2$, of nose portion 30 should be approximately 1.2 to 1 or $l_1$ should be approximately 55% of the total length, L, of projectile 22. In addition, it is also seen that the diameter, D, of cylindrical body portion 24 of projectile 22 is substantial with respect to the overall length, L, thereof or stated more succinctly slightly larger than the length $l_1$, of the cylindrical body portion 24, that is, $l_1 \cong 0.85D$. An example of the dimensions of projectile 22 of this invention would be an overall length, L, of approximately 0.55 inches, a diameter, D, of approximately 0.35 inches and a length, $l_1$, of cylindrical body portion 24 of approximately 0.3 inches.

In order to provide that the center of pressure of projectile 22 is as far forward of the center of gravity 26 as possible, the nose portion 30 is in the shape of a truncated cone having a rounded forward end 31 meeting a flat front surface 28. Note that this embodiment contains a typical core material 21 such as lead, lead alloy, steel or iron and is encased except for part of the base 25 by a smooth outer surfaced jacket, 23 made of, for example, gilding metal, cupronickel or guilding metal clad steel. The jacket 23 allows the projectile to maintain form and integrity after impact with a body and therefore making it legal for use in warfare.

Figure 4:
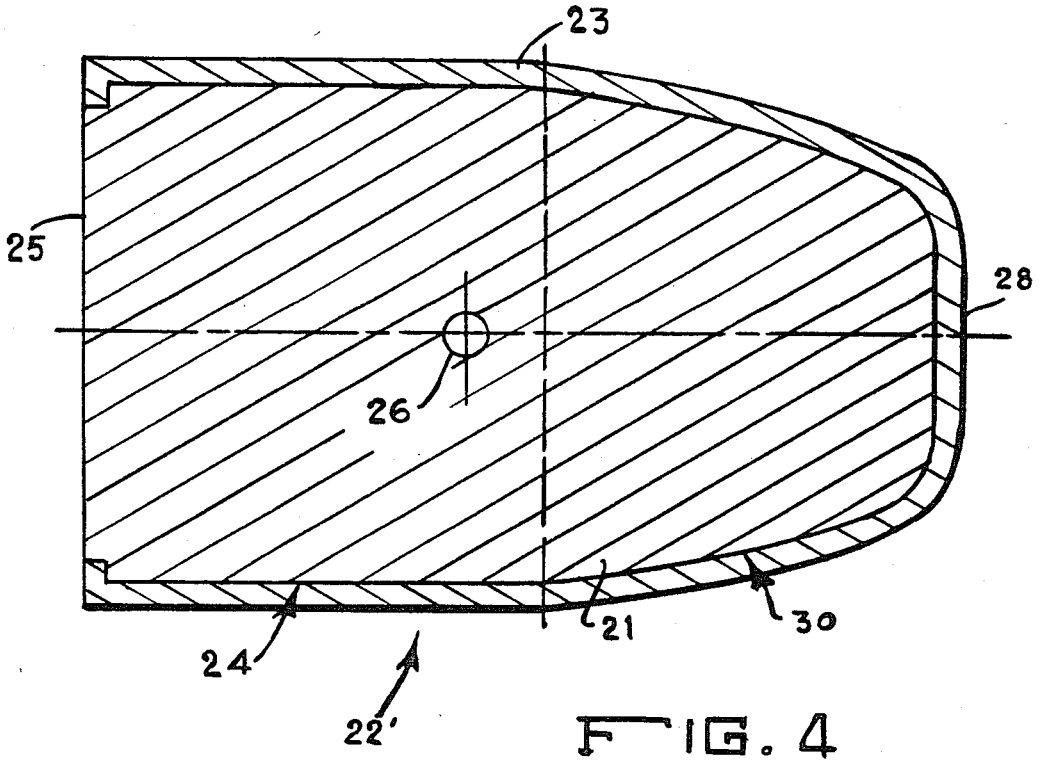
FIG. 4 is a side elevational view of an alternate embodiment of the projectile of this invention showing a permissible curved transition between the essential flat nose and essential long cylindrical body.

Another embodiment of the invention is shown in FIG. 4 of the drawing. The embodiment of FIG. 4 illustrates a projectile 22' containing a minor variation of projectile 22 shown in FIG. 2. In the embodiment shown in FIG. 4 the transition between the essential flat nose 28 and the essential long cylindrical body 24 has a curved rather than a conic form, however it still contains all of the essential features of this invention.

Figure 5:
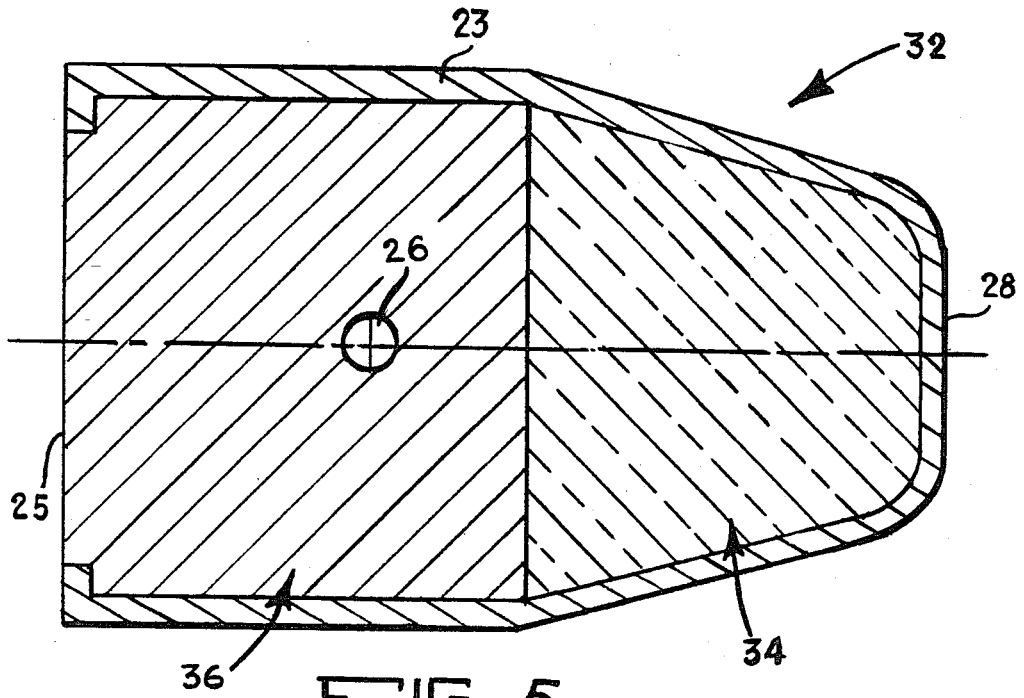
FIG. 5 is a side elevational view of a alternate embodiment of the projectile of this invention for use with small arms made of two different materials and shown in cross section.

Although it is essential with the present invention to position the center of gravity 26 somewhere within the cylindrical portion 24 of projectile 22 it is preferable in obtaining maximum accuracy to position the center of gravity 26 as far within the rear of cylindrical portion 24 as possible. This is accomplished by the completely flat base 25 or cylindrical portion 24 illustrated in all the Figures of the drawing of this invention. Further as shown in FIG. 5 of the drawing by providing a projectile 32 in which the nose portion 34 is cored with a lightweight material such as plastic or aluminum while the cylindrical body portion 36 is cored with any suitable heavy material such as lead or the like, the center of gravity 26 can be displaced rearward.

Figure 6:
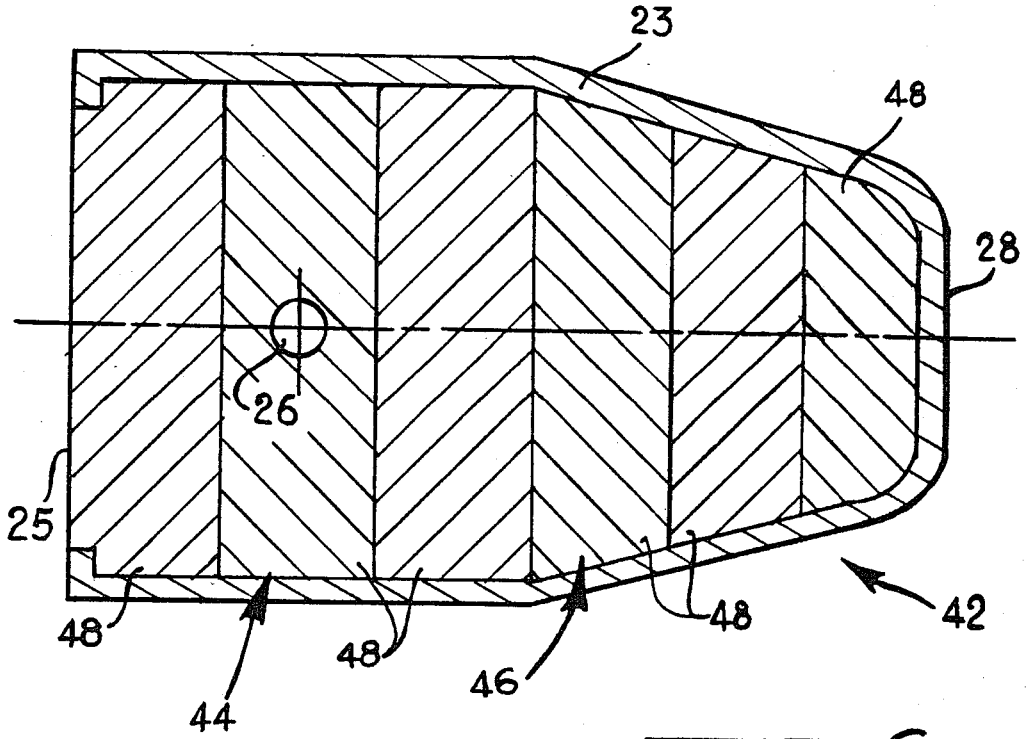
FIG. 6 is a side elevational view of another alternate embodiment of the projectile of this invention for use with small arms made with a core of laminated construction and shown in cross section.
Figure 7:
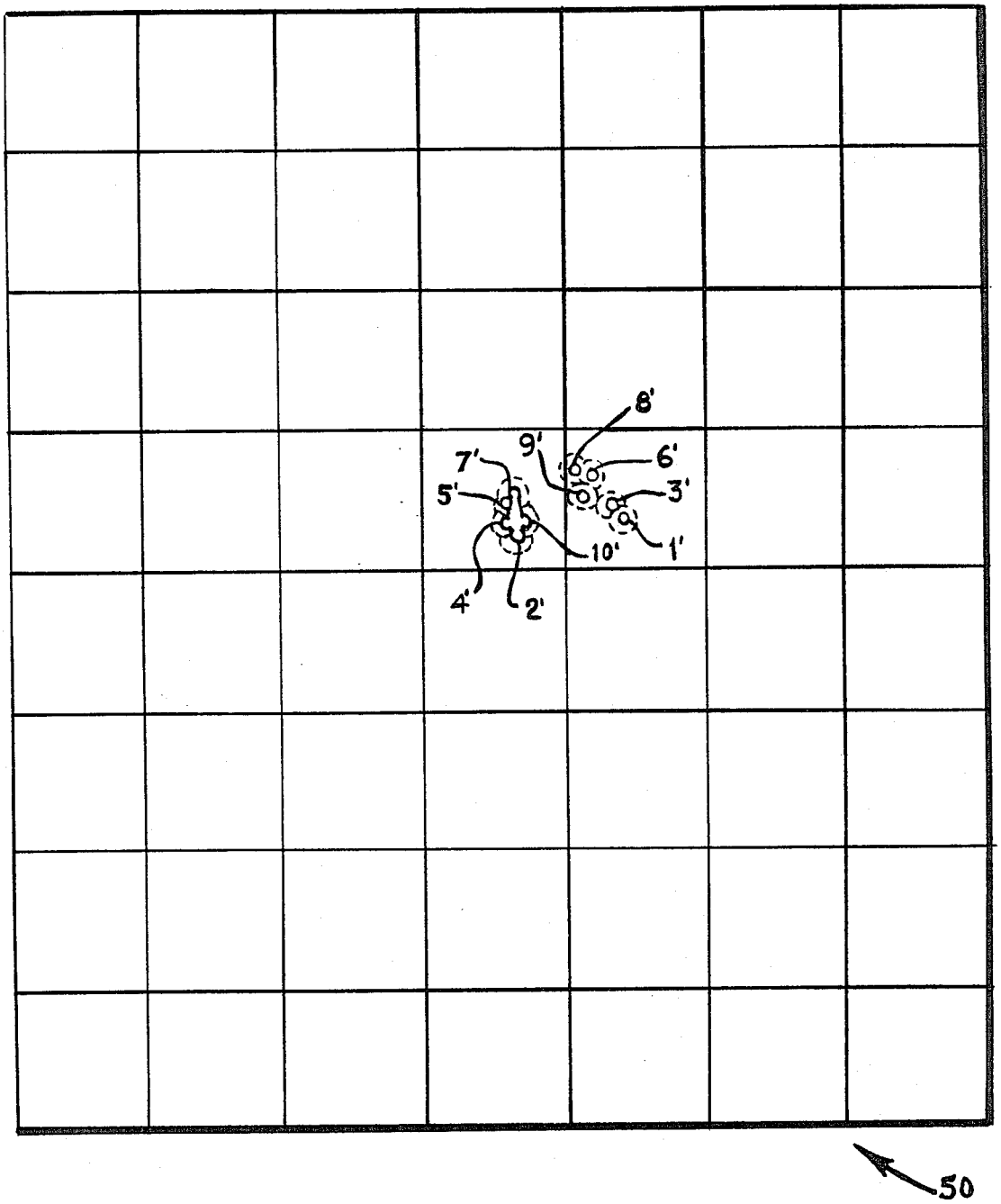
FIG. 7 is an illustration of a typical target for use with small arms ammunition showing a highly accurate ten-shot group at fifty yards utilizing the projectile of this invention.

Still another embodiment shown in FIG. 6 of the drawing illustrates a projectile 42 in which both the body portion 44 and nose portion 46 of projectile 42 made of a laminated construction wherein each lamination 48 of the core is made of material of different density with the material of greatest density being toward the rear of cylindrical body portion 44 of projectile 42. Or, stated more succinctly, each of the laminations 48 increase in density in direct relationship to its distance from flat nose 28 to base 25.

The accuracy of ammunition utilizing projectile 22 of this invention (or the modified embodiments thereof) is clearly depicted in FIG. 6 of the drawing which illustrates a typical target 50 utilized in conjunction with ammunition for small arms. In a ten shot group (numbered 1' to 10') at a range of approximately fifty yards, it is possible using projectile 22 of this invention to produce a spread of approximately only one inch. The accuracy utilizing projectile 22, 22', 32 and 42 of this invention is therefore increased by a factor of about eight over the prior art projectile 10 shown in FIG. 1 of the drawing. Consequently, by the unique construction of the present invention extreme accuracy can be obtained utilizing small arms in a manner heretofore virtually impossible.

Although this invention has been described with reference to a particular embodiment, it will be understood that this invention is also capable of further and other embodiments within the spirit and scope of the appended claims.

We claim:

1. A highly accurate metal jacketed projectile for use with small arms, said projectile having a specific configuration comprising:

a cylindrically-shaped body portion having a predetermined length and a predetermined diameter, a forward end and a completely flat rear end;

a nose portion formed adjacent said forward end of said body portion, said nose portion being substantially in the shape of a truncated cone terminating in a completely flat front surface;

said body portion and said nose portion including a completely solid core encapsulated by a metal jacket, and said metal jacket having a completely smooth outer surface; and said projectile having an overall predetermined length, said predetermined length of said cylindrically-shaped body portion being equal to approximately 55% of said overall predetermined length of said projectile and also equal to approximately 85% of said diameter of said body portion, and said overall predetermined length of said projectile being equal to approximately 1.55 times said predetermined diameter of said body portion;

wherein said specific configuration of said projectile provides that the center of gravity of said projectile be located within said body portion and the center of pressure of said projectile be located substantially forward of said center of gravity of said projectile.

2. A highly accurate projectile for use with small arms as defined in claim 1 wherein said core of said cylindrically-shaped body portion is made of one material and said core of said nose portion is made of another material and wherein said core material of said body portion is of greater density than said core material of said nose portion.

3. A highly accurate projectile for use with small arms as defined in claim 1 wherein said core of said cylindrically-shaped body portion and said core of said nose portion of said projectile are made of a plurality of materials, each of said plurality of materials increasing in density in direct relationship to its distance from said completely flat surface of said nose portion to said base of said body portion.

4. A highly accurate projectile for use with small arms as defined in claim 1 wherein said nose portion has a rounded section between the sides of said substantially truncated nose portion and said completely flat front surface thereof to aid in feeding in automatic weapons.

5. A highly accurate projectile for use in small arms as defined in claim 1 wherein said jacket is fabricated from a homogeneous metal or alloy of sufficient strength and hardness so as to prevent said projectile from breaking up or deforming excessively when striking a human body.

* * * * *